US007063322B2

(12) United States Patent
Safar

(10) Patent No.: US 7,063,322 B2
(45) Date of Patent: Jun. 20, 2006

(54) PUZZLE GAME COMPRISING A PLURALITY OF CHAMBERS AND STACKED, SLIDABLE TILES WITHIN A RIGID HOLDING BASE PRESENTING A CHALLENGING PUZZLE TO SOLVE

(76) Inventor: Samir Hanna Safar, 13790 Rosecroft Way, San Diego, CA (US) 92130

( * ) Notice: Subject to any disclaimer, the term of this patent is extended or adjusted under 35 U.S.C. 154(b) by 0 days.

(21) Appl. No.: 10/839,004

(22) Filed: May 5, 2004

(65) Prior Publication Data

US 2005/0248089 A1 Nov. 10, 2005

(51) Int. Cl.
*A63F 9/08* (2006.01)

(52) U.S. Cl. ..... 273/153 S

(58) Field of Classification Search ..... 273/153 R, 273/153 S, 157 R

See application file for complete search history.

(56) References Cited

U.S. PATENT DOCUMENTS 4,402,510 A * 9/1983 Yokoi ..... 273/153 S
4,493,487 A * 1/1985 Ferrigni ..... 273/153 S
5,060,948 A * 10/1991 Hausner ..... 273/153 S
5,836,584 A * 11/1998 Chen ..... 273/153 S
6,186,504 B1 * 2/2001 Maxim ..... 273/153 S
6,773,011 B1 * 8/2004 Rom ..... 273/153 S

* cited by examiner

*Primary Examiner*—Steven Wong
(74) *Attorney, Agent, or Firm*—White-Welker & Welker, LLC

(57) ABSTRACT

The puzzle apparatus of the present invention presents a challenging logic-based puzzle wherein the user attempts to arrange tiles within one or more chambers until a particular predetermined pattern is achieved (the solution). The apparatus and game play methodology of the present invention differs from that in the prior art in that as the tiles are slid from one matrix column to another the moved tile covers the existing tile located in the matrix column the moving tile is being traveling toward, while the matrix column the moving tile is exiting replaces the moving tile with one located directly underneath it in the matrix column thereby cause a new, unknown tile to replace the moving tile. This added dimension makes it very challenging to arrange the tiles to display a predetermined pattern and achieve the solution. The major elements consist of rigid housing creating a matrix of columns (also referred to as chambers), each chamber containing a base piece attached to a compression spring, multiple sliding tiles, and retaining buttons. The slidable and stackable tiles are interchangeable and relatively arrangeable to produce a solution to the puzzle. The solution includes a predetermined pattern as viewable by the user when looking generally toward the opening of the housing. A method for solving a puzzle in accordance with the invention is also provided.

3 Claims, 15 Drawing Sheets

1000

1100

1200

1300

PUZZLE GAME COMPRISING A PLURALITY OF CHAMBERS AND STACKED, SLIDABLE TILES WITHIN A RIGID HOLDING BASE PRESENTING A CHALLENGING PUZZLE TO SOLVE

CROSS REFERENCE TO RELATED APPLICATIONS

Not Applicable

FEDERALLY SPONSORED RESEARCH

Not Applicable

SEQUENCE LISTING OR PROGRAM

Not Applicable

Technical Field of the Invention

The present invention relates generally to games and more particularly to a puzzle game that is intended to provide the user with a challenge to solve.

BACKGROUND OF THE INVENTION

People have long been fascinated and entertained by logic-based puzzles. Manipulative puzzles such as the vastly popular Rubik's cube are commercially available and well known in the prior art. Rubik's cube is a mechanical puzzle invented by the Hungarian sculptor and professor of architecture Emo Rubik in 1974. Is has been estimated that over 100,000,000 Rubik's cubes or imitations have been sold worldwide.

A Rubik's cube is a cubic block with its surface subdivided so that each face consists of nine squares. Each face can be rotated, giving the appearance of an entire slice of the block rotating upon itself. This gives the impression that the cube is made up of 27 smaller cubes (3×3×3). In its original state each side of a Rubik's cube is a different color, but the rotation of each face allows the smaller cubes to be rearranged in many different ways. The challenge is to be able to return the cube to its original state from any position.

The Rubik's cube reached its height of popularity during the early 1980's. Many similar puzzles were released shortly after the Rubik's cube, both from Rubik himself and from other sources, including the Rubik's Revenge, a 4×4×4 version of the Rubik's cube. There are also 2×2×2 and 5×5×5 cubes (known as the Pocket Cube and the Professor's Cube, respectively), and puzzles in other shapes, such as the Pyraminx™, a tetrahedron.

Another logic-based puzzle that is known and is more familiar to the embodiment of the present invention is a 4×4 square grid having fifteen slidable tiles number 1–15 occupying fifteen of the sixteen spaces within the grid. Tiles can be slid sequentially into the empty space in the grid, thereby altering the relative positions of the numbered tiles. The typical solution to such a puzzle is obtained when the tiles are numerically ordered 1–15 reading left-to-right across the columns and then down the rows.

Many other logic-based puzzles exist using recognizable patterns of colors, letters, numbers, and images, and the like to distinguish solutions states form non-solutions states. There remains a need, however, for a manipulative puzzle solving game that provides a variety of puzzles for the player to solve.

SUMMARY OF THE INVENTION

In accordance with the present invention there is provided a puzzle apparatus for providing a user with a challenging puzzle to solve. The apparatus includes a housing having at least one opening therein, a matrix of chambers disposed within the housing, and a plurality of generally interchangeable slidable and stackable tiles, slidable tiles carrying colors, numbers, symbols, or themes.

The slidable and stackable tiles are interchangeable and relatively arrangeable to produce a solution to the puzzle. The solution includes a predetermined pattern as viewable by the user when looking generally toward the opening of the housing. A method for solving a puzzle in accordance with the invention is also provided.

The puzzle apparatus of the present invention presents a challenging logic-based puzzle wherein the user attempts to arrange tiles within one or more housing openings until a particular predetermined pattern is achieved (the solution). The apparatus and game play methodology of the present invention differs from that in the prior art in that as the tiles are slid from one matrix column to another the moved tile covers the existing tile located in the matrix column the moving tile is being traveling toward, while the matrix column the moving tile is exiting replaces the moving tile with one located directly underneath it in the matrix column thereby cause a new, unknown tile to replace the moving tile. This added dimension makes it very challenging to arrange the tiles to display a predetermined pattern and achieve the solution.

In another embodiment of the present invention an art set having tiles that illustrate common features (such as Disney characters, or artistic elements) may be used in accordance with the puzzle apparatus of the present invention. This embodiment differs from the typical puzzle since there is no predetermined arrangement of tiles (no solution) that is sought to be formed. Rather, the object of the art set is to facilitate the creation of a visually pleasing, colorful, and artistic or individually desired tile arrangements.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

Referring to the figures, it is possible to see the various major elements constituting the apparatus of the present invention. The invention is a logic based puzzle game with several additional elements that operate together in such a manner to challenge players to arrange the tiles in a predetermined patter to achieve the desired solution. The major elements consist of rigid housing creating a matrix of columns (also referred to as chambers), each chamber containing a base piece attached to a compression spring, multiple sliding tiles, and retaining buttons.

Figure 1:
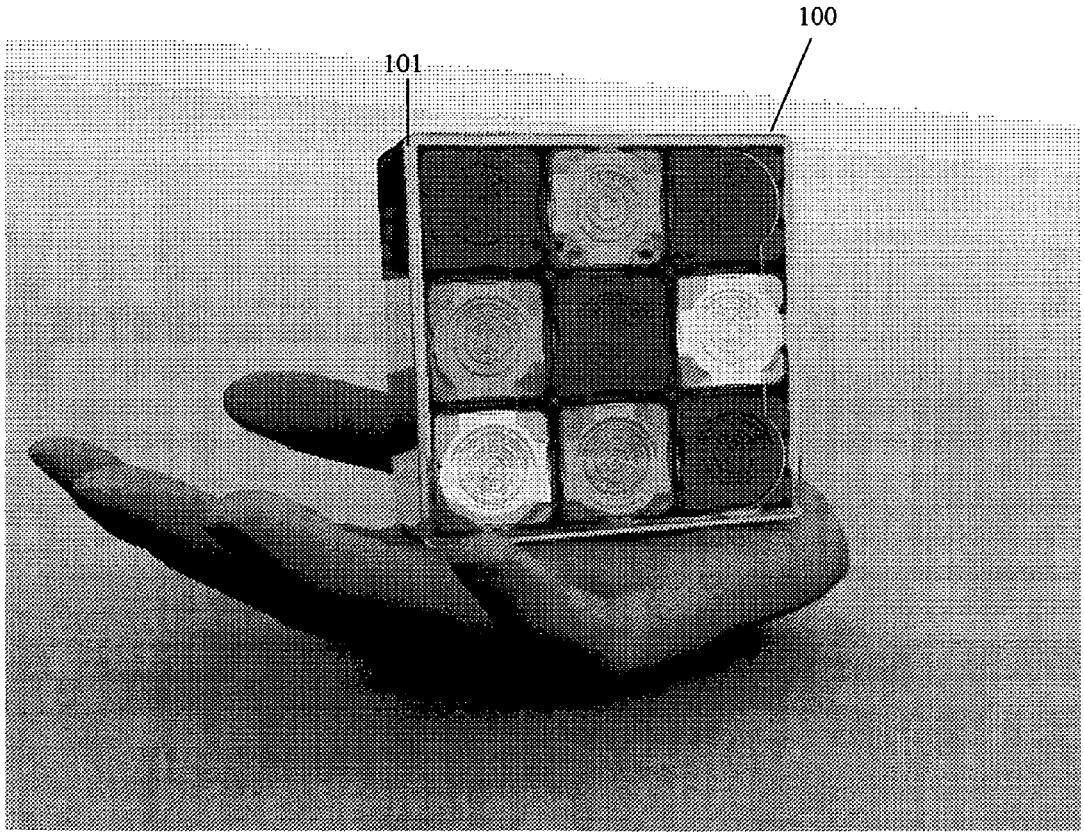
FIG. 1 is a perspective view of a puzzle apparatus in accordance with the present invention.
Figure 2:
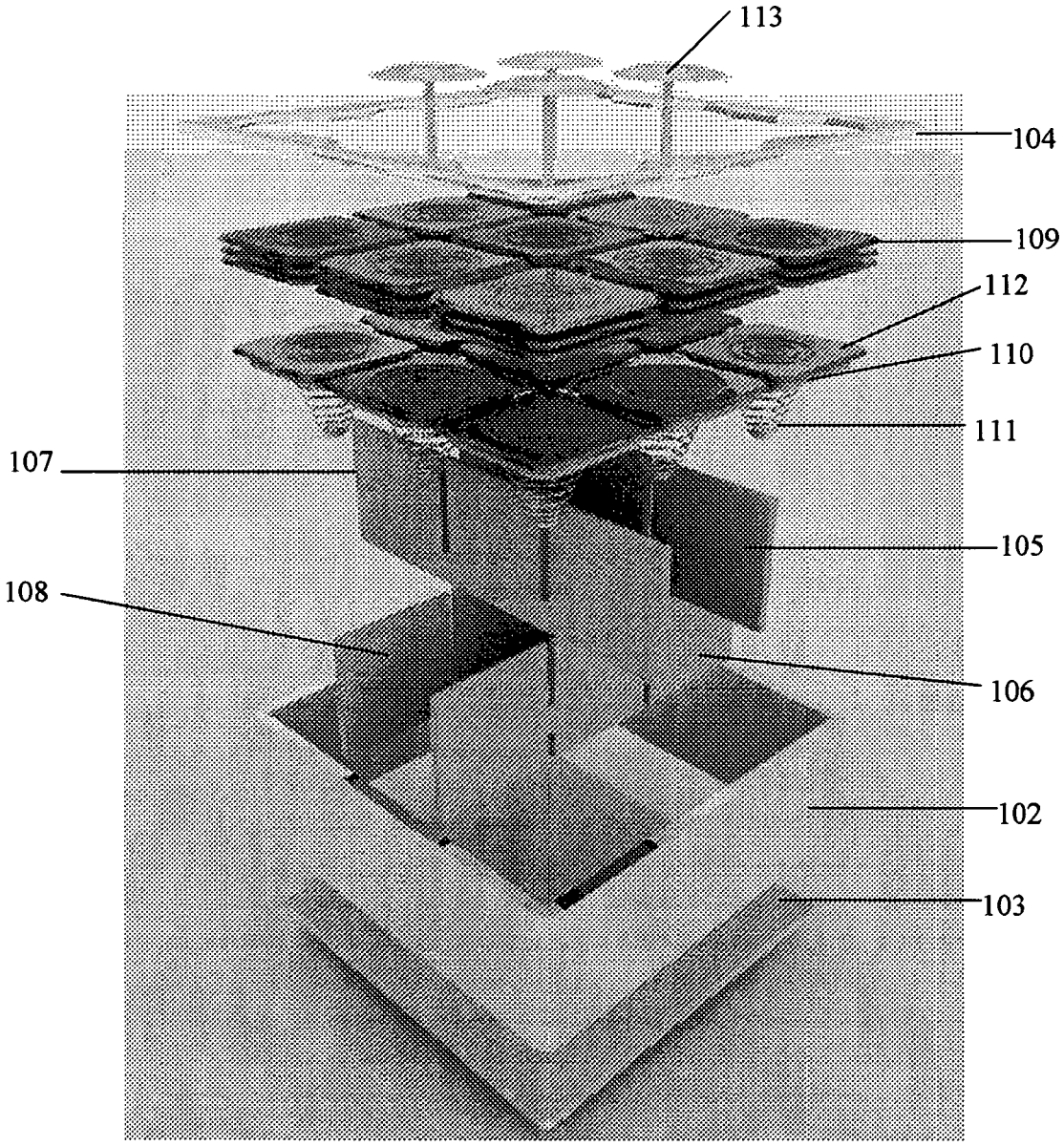
FIG. 2 is an exploded perspective view of the puzzle apparatus of FIG. 1 to facilitate viewing individual components thereof.
Figure 4:
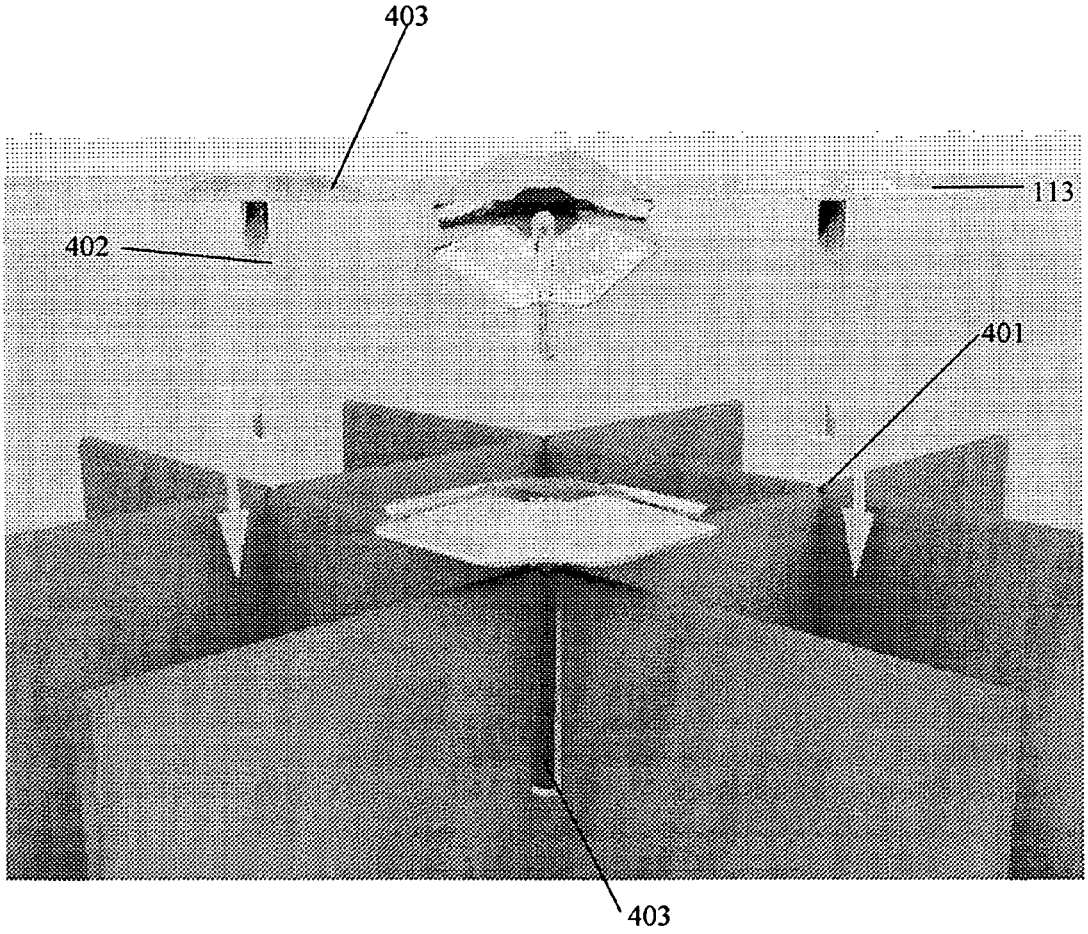
FIG. 4 is a perspective view of the housing illustrating the movement and installation of the tile retaining buttons of the present invention.
Figure 5:
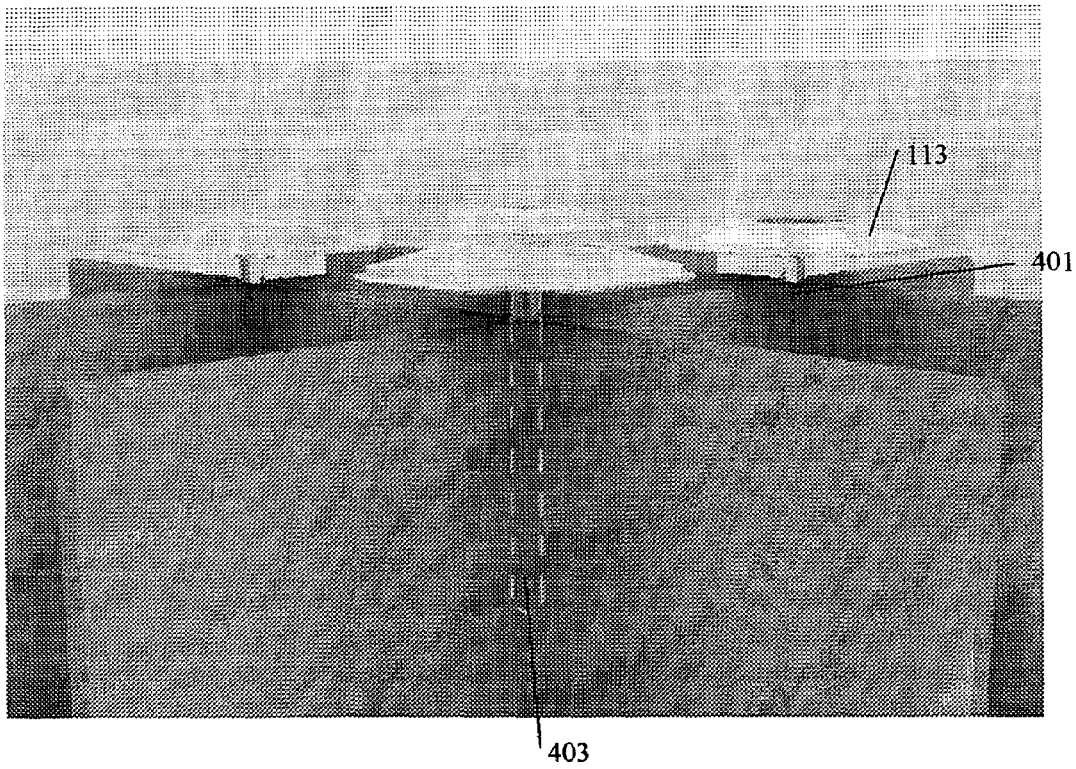
FIG. 5 is a perspective view of the housing and tile retaining buttons of the present invention.

A preferred embodiment of the present invention is described herein and shown in puzzle apparatus (100) of FIG. 1 and in exploded form in FIG. 2. The puzzle apparatus (100) includes a rigid housing (101) having side portions (102) a bottom portion (103) and a top portion (104). The top portion (104) also contains tapered edges (403) to facilitate easier pushing of the sliders. The rigid housing (101) has dividers (105, 106, 107 and 108) that are inserted into the rigid housing (101) to create chambers. Each chamber is filled with a stack of colored slider tiles, also referred to as sliders, (109) that are stacked on a base piece (110) that is attached to a compression spring (111). The last tile (112) in a chamber is not attached to the base piece (110). The base piece (110) has a flat surface which, in the preferred embodiment is a solid color, but could whose appearance could be altered to make it appear as a slider. The base piece (110) and compression spring (111) are fixed in the chamber by the dividers (105, 106, 107 and 108) eliminating any significant amount of sideways movement. Buttons (113) are sitting on the posts created by the intersections of the rigid housing dividers (105, 106, 107 and 108) as illustrated in FIGS. 4 and 5. The buttons (113) provide a unique function not found in the prior art as they enable the sliding tiles to be rotated in a 360-degree motion around them.

It is important to note that the embodiment described above and shown in FIGS. 1 and 2 represents a single embodiment of the present invention, and a significant rage of alternative embodiments is contemplated to be within the scope of the present invention. Readily apparent to one of ordinary skill in the art is that there is no dimensional limitation to the puzzle apparatus of the present invention and, as such, any dimensional configuration is considered to be within the scope of the invention. In the preferred embodiment of the puzzle apparatus of the present invention the minimum lower limit of chambers is three.

Figure 3:
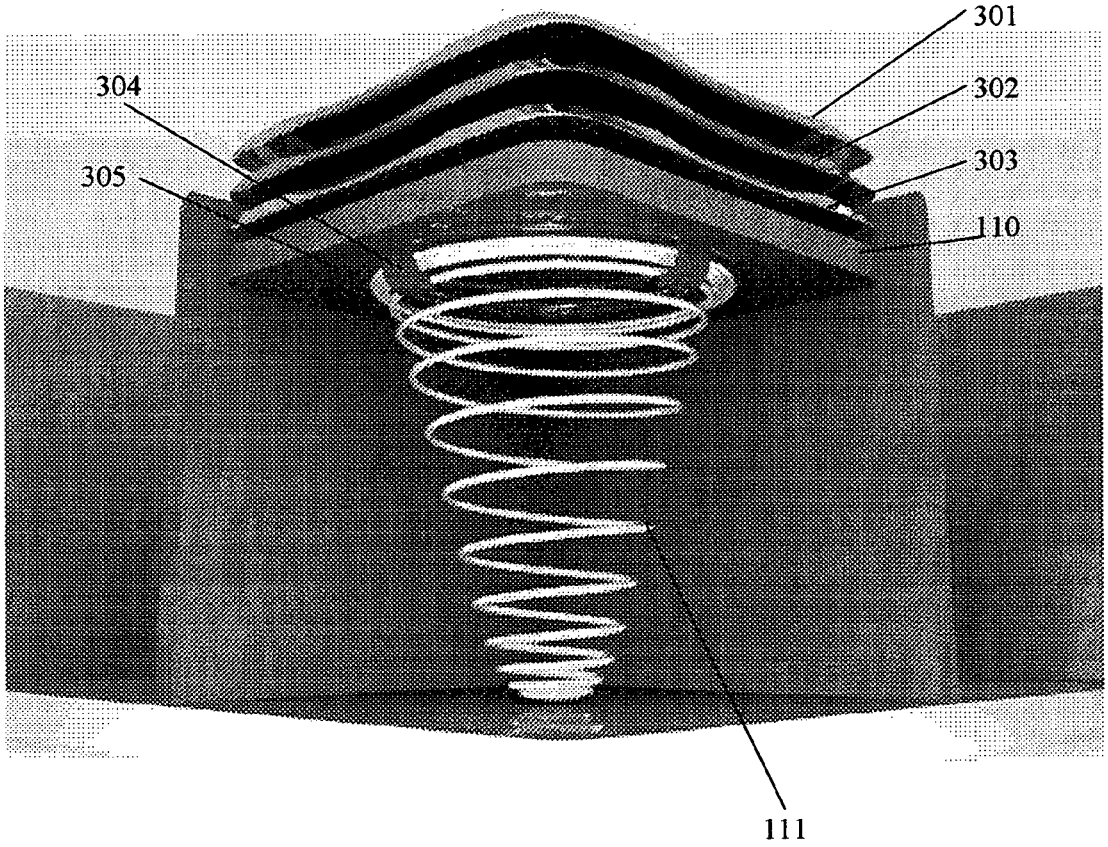
FIG. 3 is a perspective view of a matrix column and tiles of the present invention.

FIG. 3 illustrates a typical chamber configuration of the present invention. Slidable tiles (301, 302 & 303) are stacked up to the top surface of a base piece (110). The base piece (110) is attached to a compression spring (111). The compression spring (111) is a cone shaped spring to maximize the number of tiles that can be stacked in the chamber. A cone shaped spring is unique in that, when compressed, it can be reduced to the dimensions of its single largest coil. While a cone shape spring is illustrated in the various embodiment of the puzzle apparatus of the present invention one of ordinary skill in the art will appreciate that any spring could be used. There are four little hocks (304) located at on the bottom portion of the base piece (305) of the rigid housing (101) where the compression spring (111) snaps in between. The four little hocks (304) have a flat topside surface.

Now referring to FIGS. 4 and 5 buttons (113) are sitting on the posts (401) created by the intersections of the rigid housing dividers. The button shafts (402) are inserted into and retained by the openings created by the intersections of the rigid housing dividers and extend therein to (403). The buttons also contain tapered edges (403) to facilitate easier pushing of the sliders. The buttons (113) provide a unique function not found in the prior art as they enable the sliding tiles to be rotated in a 360-degree motion around them and also retain the slides, and base in a given chamber.

Figure 6:
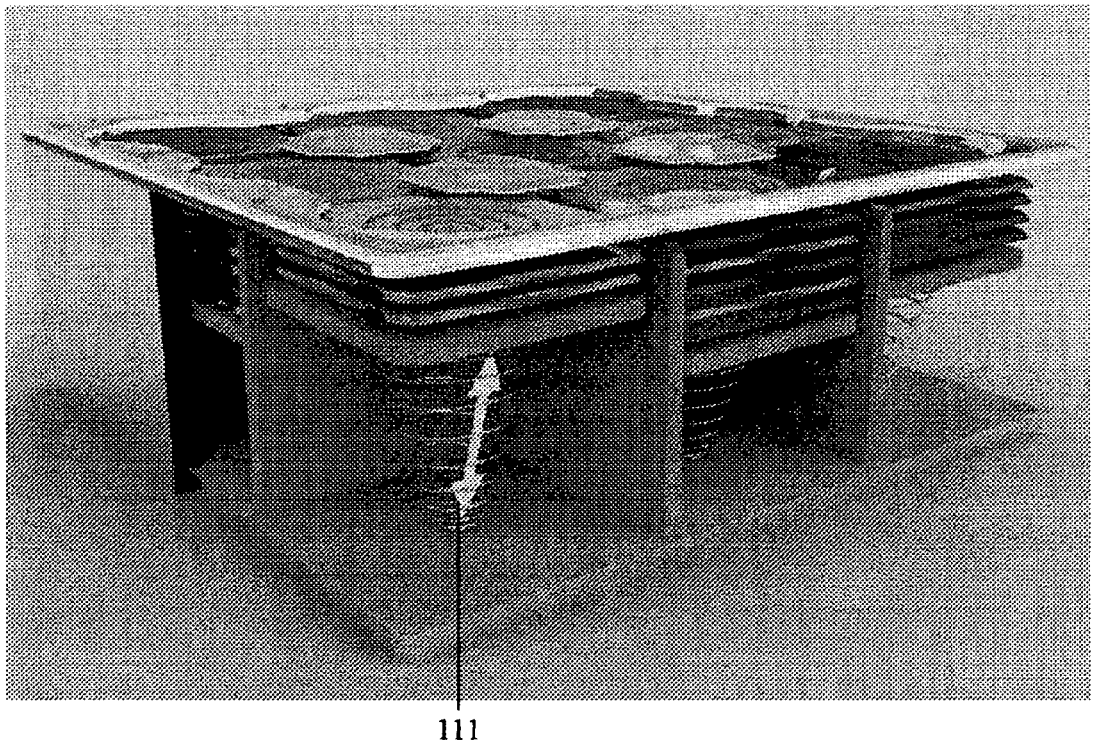
FIG. 6 is an exploded perspective view of the puzzle apparatus of the present invention to facilitate viewing individual components as assembled in the puzzle apparatus of the present invention.
Figure 8:
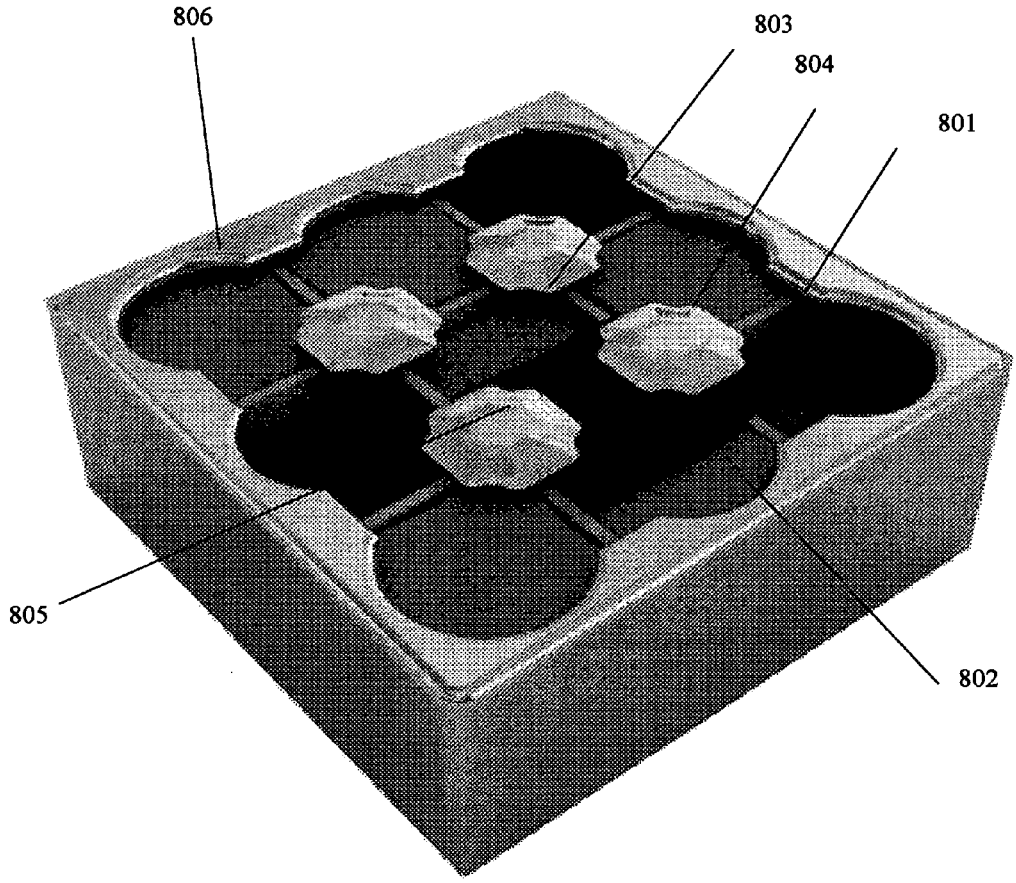
FIG. 8 is a perspective view of the assembled puzzle apparatus of the present invention illustrating the movement of a tile.

Players slide the sliders from one chamber to another by initially pressing a first slider slightly down in a first chamber using a finger or thumb and then pushing a second slider from an adjacent second chamber onto the first chamber using a finger or thumb. In this manner a first slider is pushed down and a second slider is pushed sideways using a finger or thumb to effectuate the movement of sliders throughout the puzzle apparatus of the present invention. FIG. 6 illustrates the movement of the compression spring (111) as it is pressed down by a player and its return path when the player's pressure is removed. FIG. 8 illustrated the path a slider. (801) takes as it moves from a first chamber (802) to a second chamber (803). As the slider (801) moves from a first chamber (802) to a second chamber (803) it is retained in the puzzle apparatus by adjacent buttons (804 & 805) which it contacts during it movement.

Figure 9A:
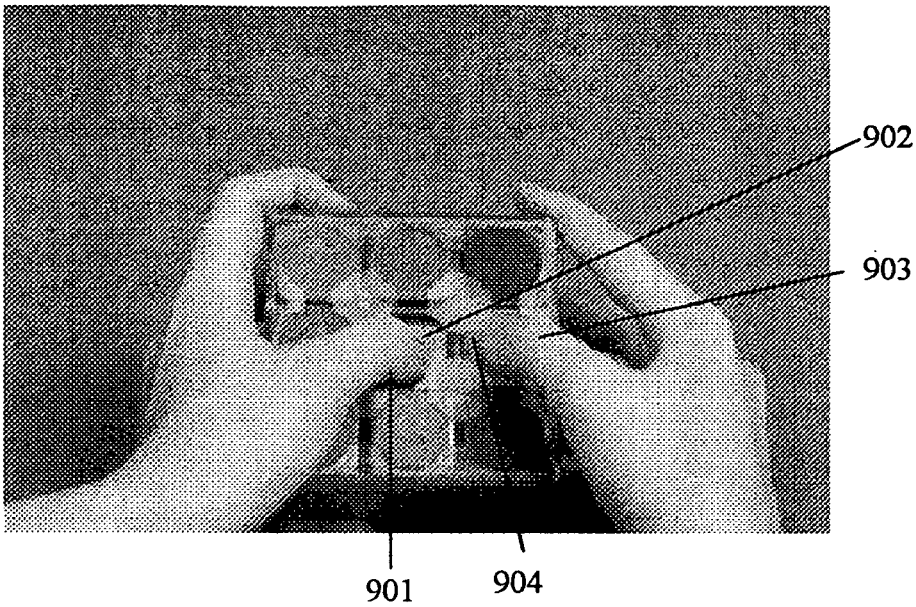
FIGS. 9*a* and 9*b* illustrate the steps required to move a tile from one matrix column to an adjacent matrix column in the puzzle apparatus of the present invention.
Figure 9B:
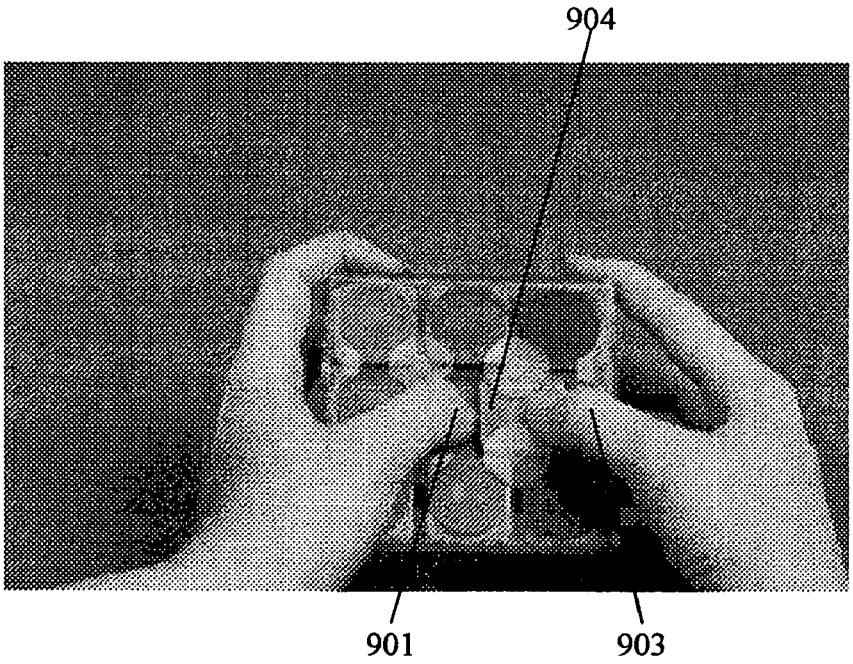

As shown in FIGS. 9*a* and 9*b* a player first uses a first thumb (901) to compresses a stack of tiles (902) and then a second thumb (903) to move a slider (904) from a first chamber to a second chamber.

Figure 10:
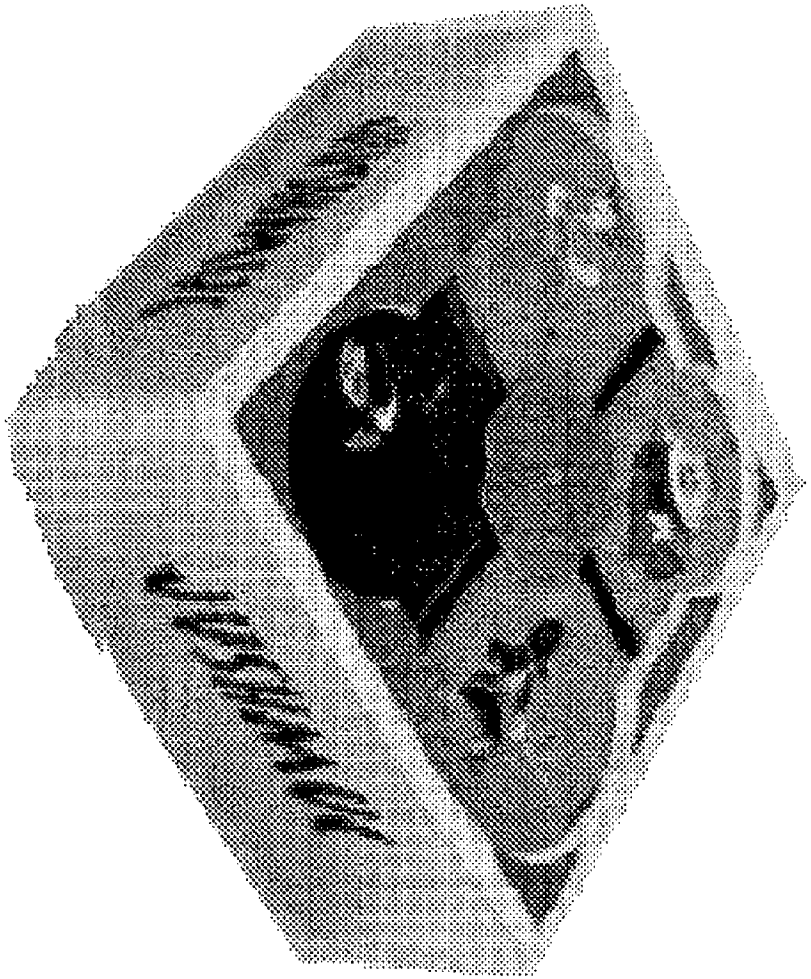
FIG. 10 is a perspective view of a 2×2 puzzle apparatus and an art set in accordance with the present invention.
Figure 11:
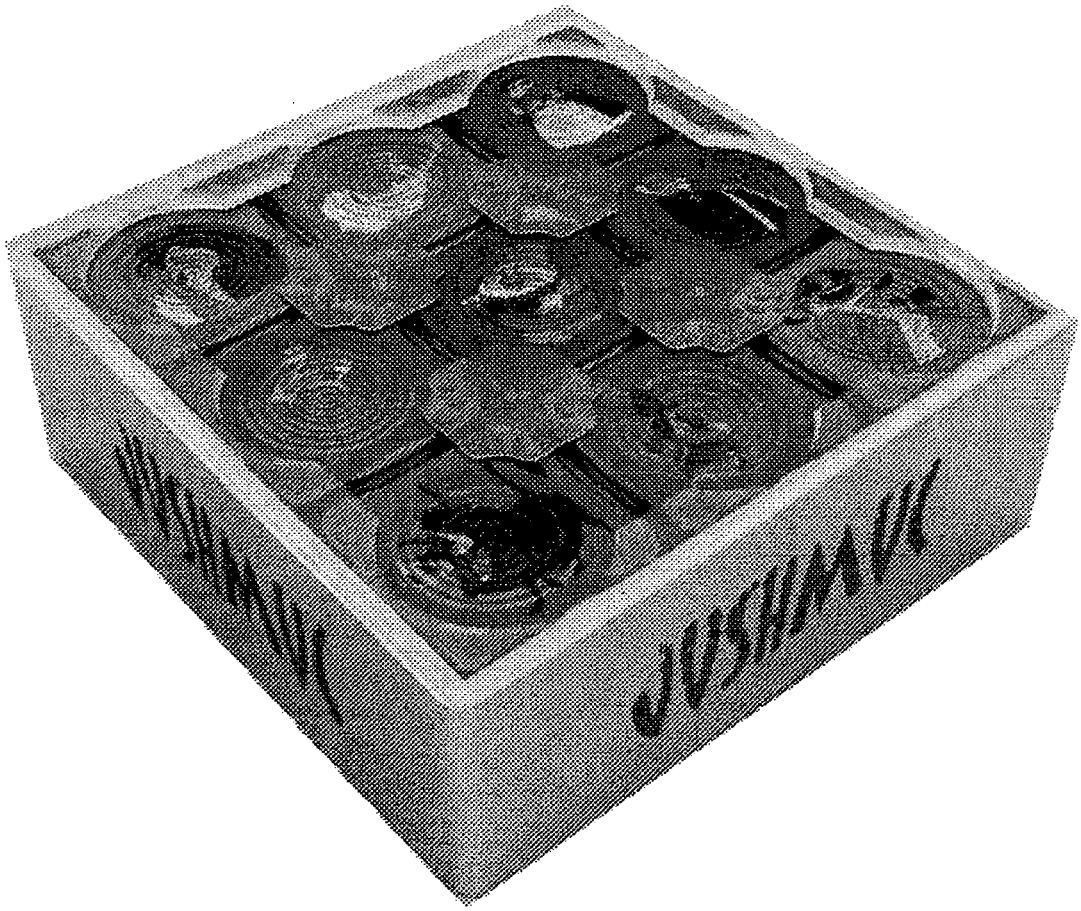
FIG. 11 is a perspective view of a 3×3 puzzle apparatus and an art set in accordance with the present invention.
Figure 12:
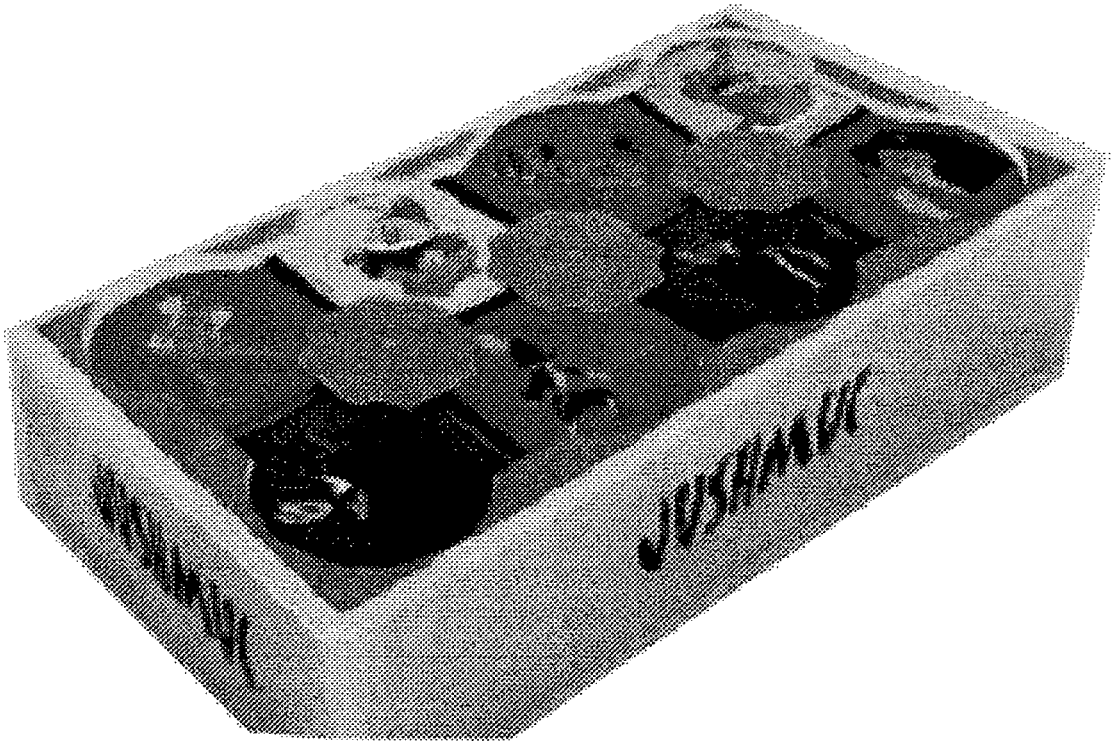
FIG. 12 is a perspective view of a 4×2 puzzle apparatus and an art set in accordance with the present invention.
Figure 13:
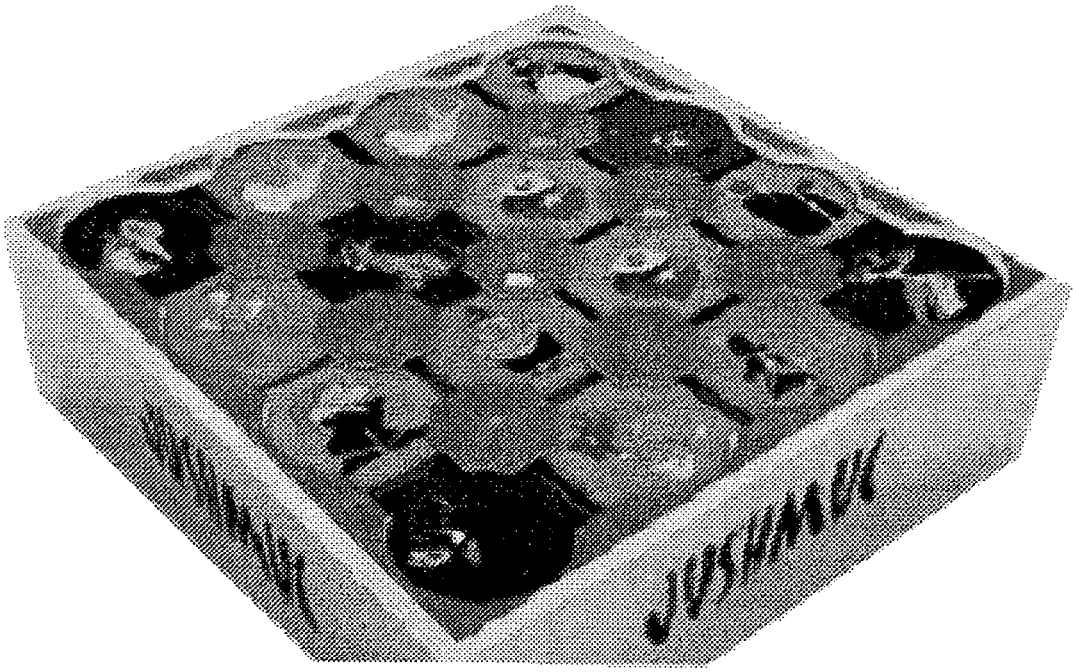
FIG. 13 is a perspective view of a 4×4 puzzle apparatus and an art set in accordance with the present invention.

FIGS. 10 thru 13, while not exhaustive, illustrate various configurations of the puzzle apparatus of the present invention. FIG. 10 depicts a 2×2 puzzle apparatus (1000) and an art set in accordance with the present invention. FIG. 11 depicts a 3×3 puzzle apparatus (1100) and an art set in accordance with the present invention. FIG. 12 depicts a 4×2 puzzle apparatus (1200) and an art set in accordance with the present invention. FIG. 13 depicts a 4×4 puzzle apparatus (1300) and an art set in accordance with the present invention.

Figure 7:
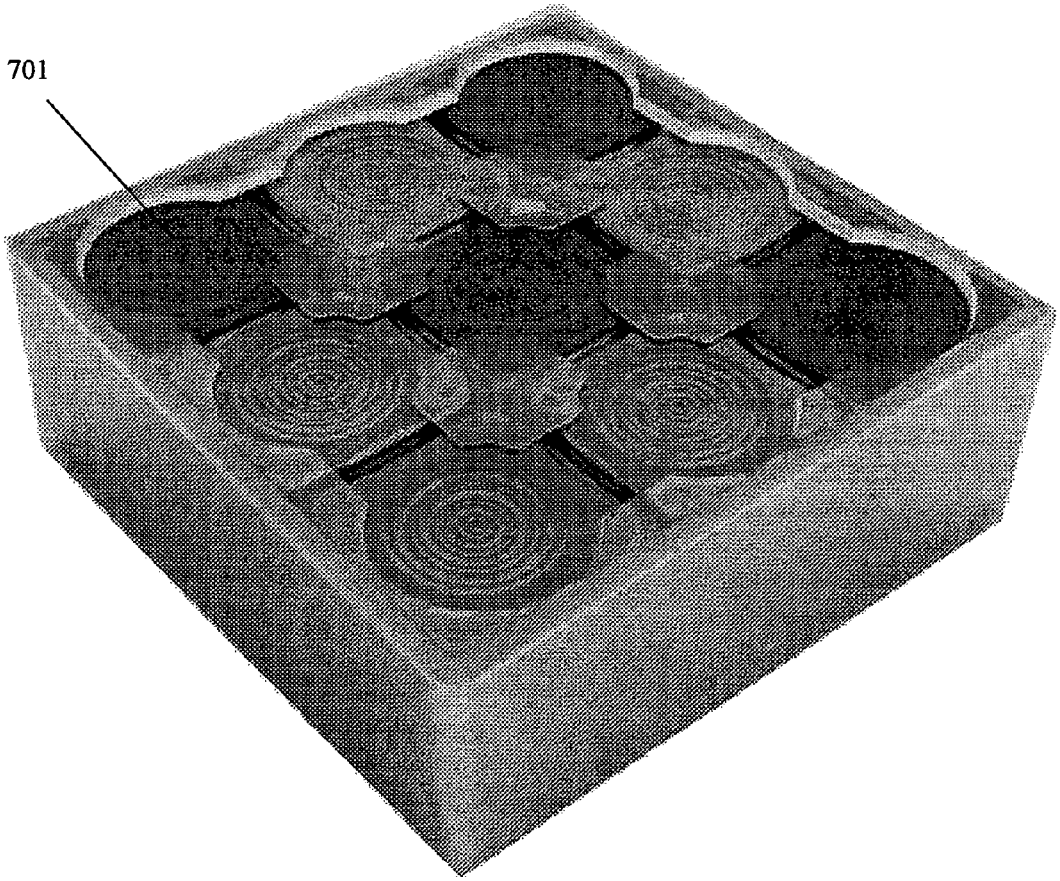
FIG. 7 is a perspective view of the assembled puzzle apparatus of the present invention.

In the preferred embodiment illustrated in FIG. 7, the puzzle apparatus (700) has nine chambers (701), each which contain a stack of colored sliders. The number of sliders depends on the depth of the chamber and the individual thickness of the sliders. Any chamber depth may be utilized, but preferably a depth that still enables one to hold the puzzle apparatus in their hand is desired. Sliders are stacked on the base piece that is attached to the compression spring (111). The player slides a slider from one chamber to another by pressing down the slider slightly and pushing it into the desired chamber using a finger or thumb. The object of the puzzle of the present invention is to get the same color, patter, or image sliders on the surface of the box.

Figure 14:
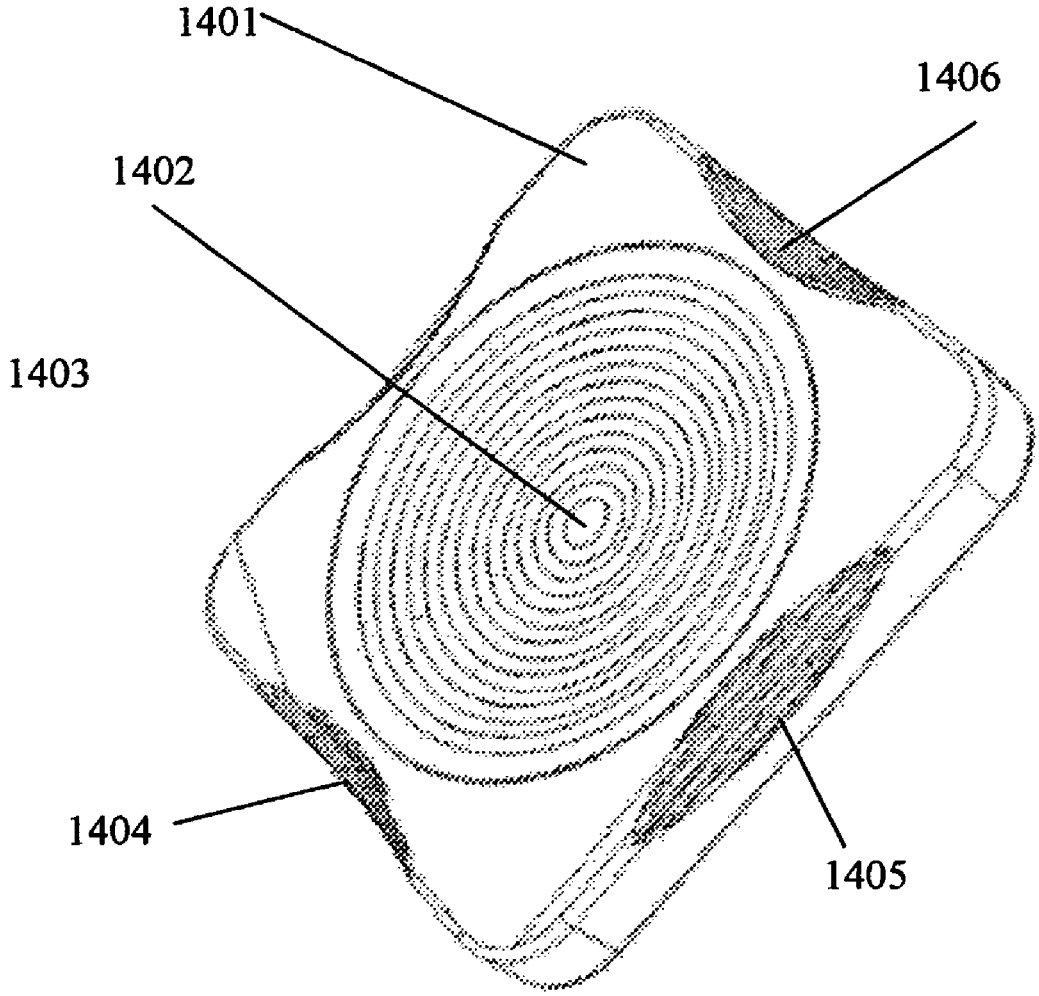
FIG. 14 is a perspective view of the top side of a sliding tile.
Figure 15:
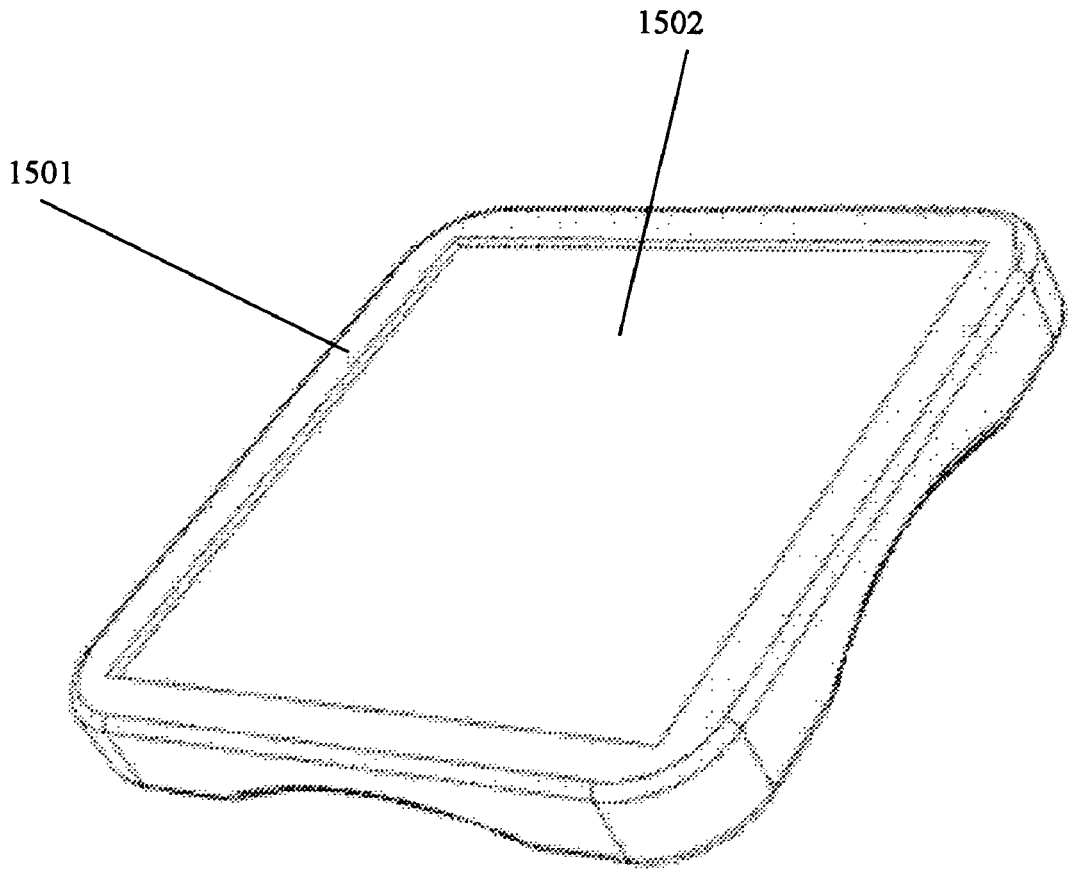
FIG. 15 is a perspective view of the bottom side of a sliding tile.

Now referring to FIGS. 14 and 15, the sliders are smooth on both the top surface (1401) and bottom surface (1501) with a shallow center depression (1402) and four shallow side depressions (1403, 1404, 1405, 1406) of the top surface (1402) for easy pushing. Additionally, the slider also has a square depression (1502) on the bottom surface (1501) for use in other embodiments of the present invention.

In yet another embodiment of the puzzle apparatus of the present invention a picture can be affixed within the square depression (1502) on the bottom surface (1501). In this embodiment the slider is clear so that a player can see the pictures or themes when view from the top surface (1401) of the slider.

It should be appreciated that one has the option to print an image on the bottom surface (1501) of a clear slider, the top surface (1401) of a slider, or affix any type of graphics or art set to the bottom surface depression (1502).

The puzzle apparatus of the present invention can have a single, unique solution or it can have multiple solutions. For example one solution might involve arranging the tiles so that all of them display an identical color. Other solutions might involve having rows or columns of distinct colors or forming recognizable patterns. Furthermore, difference solutions could be associated with different levels of complexity.

In yet another embodiment of the puzzle apparatus of the present invention the complexity of the puzzle apparatus can be increased in several ways that would be obvious to one of ordinary skill in the art. First, increasing the depth of the rigid house that would result in a deeper chamber that enables one to increase the number of sliders in the puzzle apparatus resulting in an increased complexity. Secondly, additional boxes may be combined or added together to increase the number of chambers available. One of ordinary skill in the art would appreciate the scalability of the puzzle apparatus of the present invention through the combination of two or more puzzles.

It is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention. Additionally, an electronic game or computer software that visually reproduces the described puzzle is considered to be within the scope of the invention.

Furthermore, other areas of art may benefit from this method and adjustments to the design are anticipated. Thus, the scope of the invention should be determined by the appended claims and their legal equivalents, rather than by the examples given.

The invention claimed is:

1. A puzzle apparatus for providing a user with a challenging puzzle to solve, said apparatus comprising:

a housing having at least one large opening;

one or more dividers disposed within the housing creating a plurality of smaller chambers;

said dividers extending downwardly into said housing to define said chambers;

each chamber containing one or more slider tiles;

slider tiles resting upon a base piece;

said base piece attached to a compression spring;

said base piece having attached a permanent tile;

buttons affixed to dividers for retaining said slider tiles;

said buttons being umbrella shaped; and wherein said slider tiles are relatively arrangeable to produce a solution to said puzzle.

2. An apparatus in accordance with claim 1 wherein said slider tiles are:

rectangular in shape, smooth on both the top surface and bottom surface, have a shallow center depression on the top surface, and a shallow depression on each of the four rectangular sides of the top surface.

3. An apparatus in accordance with claim 1 or 2 wherein said slider tiles are clear and any print image, picture, graphics, or art set are affixed to a depression on said bottom surface of said slider tiles for viewing from said top surface.

* * * * *